US010389052B2

(12) United States Patent
Tatzel et al.

(10) Patent No.: US 10,389,052 B2
(45) Date of Patent: Aug. 20, 2019

(54) PLUG SYSTEM WITH LOW-WEAR CONTACTING

(71) Applicant: ROSENBERGER HOCHFREQUENZTECHNIK GMBH & CO. KG, Fridolfing (DE)

(72) Inventors: Frank Tatzel, Ostermiething (AT); Christian Dandl, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/567,286

(22) PCT Filed: Apr. 19, 2016

(86) PCT No.: PCT/EP2016/000635
§ 371 (c)(1),
(2) Date: Oct. 17, 2017

(87) PCT Pub. No.: WO2016/169647
PCT Pub. Date: Oct. 27, 2016

(65) Prior Publication Data

US 2018/0109020 A1 Apr. 19, 2018

(30) Foreign Application Priority Data

Apr. 23, 2015 (DE) ..... 20 2015 003 001 U

(51) Int. Cl.
*H01R 12/72* (2011.01)
*H01R 12/89* (2011.01)
*H01R 13/193* (2006.01)

(52) U.S. Cl.
CPC ..... *H01R 12/72* (2013.01); *H01R 12/89* (2013.01); *H01R 13/193* (2013.01)

(58) Field of Classification Search
CPC ..... H01R 12/72; H01R 12/82; H01R 12/89; H01R 13/05; H01R 13/193; H01R 13/631; H01R 13/6315
See application file for complete search history.

(56) References Cited

U.S. PATENT DOCUMENTS 4,808,115 A * 2/1989 Norton ..... G02B 6/381 439/79
5,277,611 A 1/1994 Berek et al.
(Continued)

FOREIGN PATENT DOCUMENTS

CN 1574494 A 2/2005
CN 103858288 A 6/2014
(Continued)

*Primary Examiner* — Edwin A. Leon
*Assistant Examiner* — Oscar C Jimenez
(74) *Attorney, Agent, or Firm* — DeLio Peterson & Curcio LLC; Robert Curcio

(57) ABSTRACT

A plug system comprising a plug part having at least one contact element, and comprising a counter plug part having at least one contact point on a contact carrier surface running approximately parallel to an insertion direction (S), wherein the plug part can be plugged in the plug-in direction (S) into the counter plug part, and the at least one contact element is in electrical contact with the contact point in an end position (II), wherein the counter plug part has a counter-pressure surface facing the contact carrier surface at least partially in a pressing direction (H) running transversely to the plug-in direction, wherein the contact carrier surface is retained on the counter plug part such that it moves in the plug-in direction (S) relative to the counter-pressure surface.

25 Claims, 5 Drawing Sheets

(56) References Cited

U.S. PATENT DOCUMENTS

| | | | | | |
|---|---|---|---|---|---|
| 5,319,523 | A | | 6/1994 | Ganthier et al. | |
| 5,391,089 | A | * | 2/1995 | Quickel | H01R 13/193 439/260 |
| 5,411,406 | A | * | 5/1995 | Kondo | H01R 13/113 439/259 |
| 5,514,001 | A | * | 5/1996 | Szegda | H01R 13/193 439/259 |
| 5,573,415 | A | * | 11/1996 | Fujitani | H01R 12/87 439/260 |
| 5,971,773 | A | * | 10/1999 | Riddle | H01R 12/62 439/493 |
| 6,238,226 | B1 | * | 5/2001 | Schempp | H01R 12/87 439/260 |
| 6,371,781 | B1 | * | 4/2002 | Jones | H01R 12/87 439/260 |
| 7,011,548 | B2 | * | 3/2006 | Bogiel | H01R 12/727 439/247 |
| 9,306,342 | B2 | * | 4/2016 | Sellmer | H01R 12/721 |
| 2002/0064988 | A1 | * | 5/2002 | Fujita | H01R 13/7034 439/260 |
| 2015/0333442 | A1 | * | 11/2015 | Naganuma | H01R 12/7047 439/121 |

FOREIGN PATENT DOCUMENTS

| | | | |
|---|---|---|---|
| CN | 103875127 | A | 6/2014 |
| DE | 102009036807 | A1 | 3/2011 |
| WO | 9632831 | A1 | 10/1996 |
| WO | 2015006644 | A1 | 1/2015 |

* cited by examiner

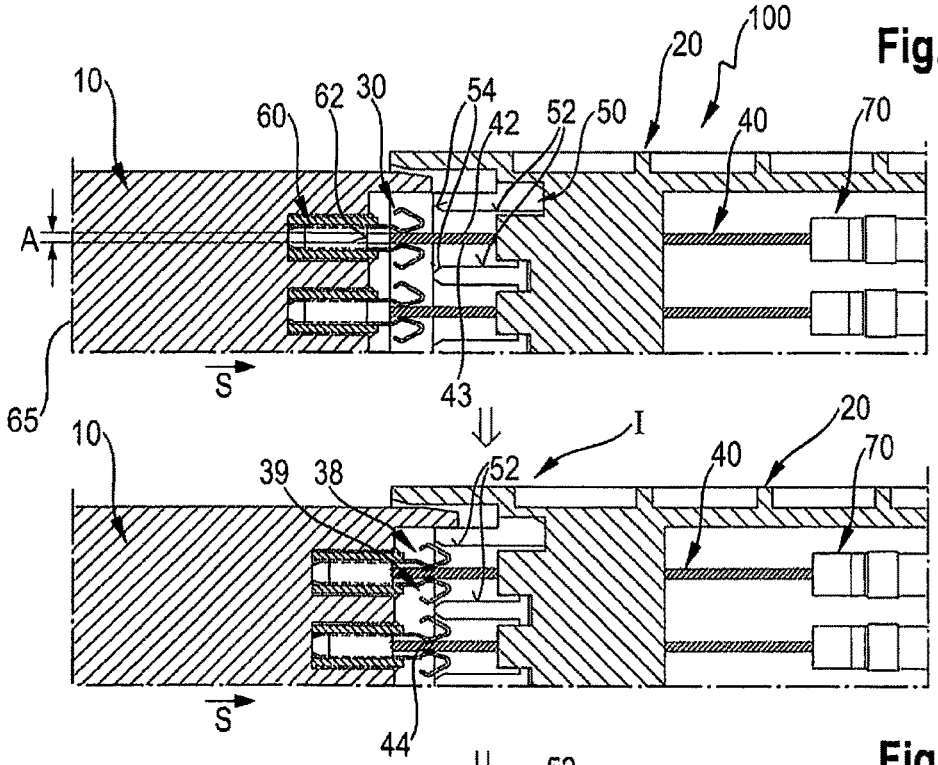
Fig. 1a
Fig. 1b
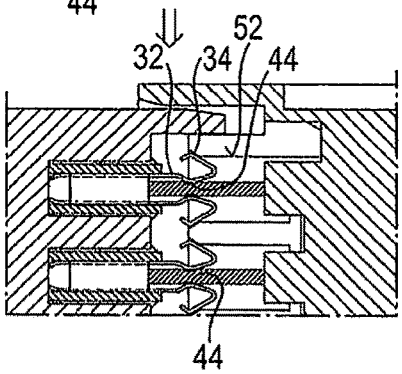
Fig. 1c
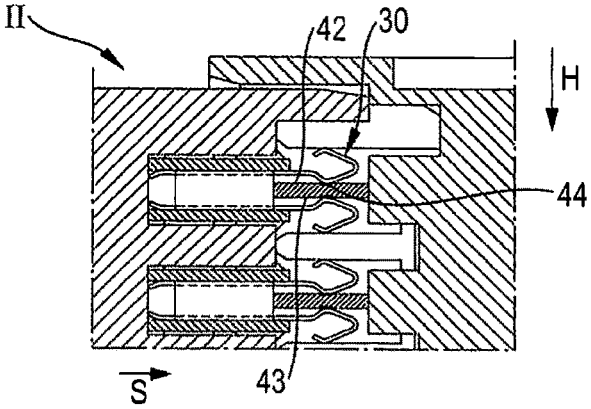
Fig. 1d

Fig. 4a
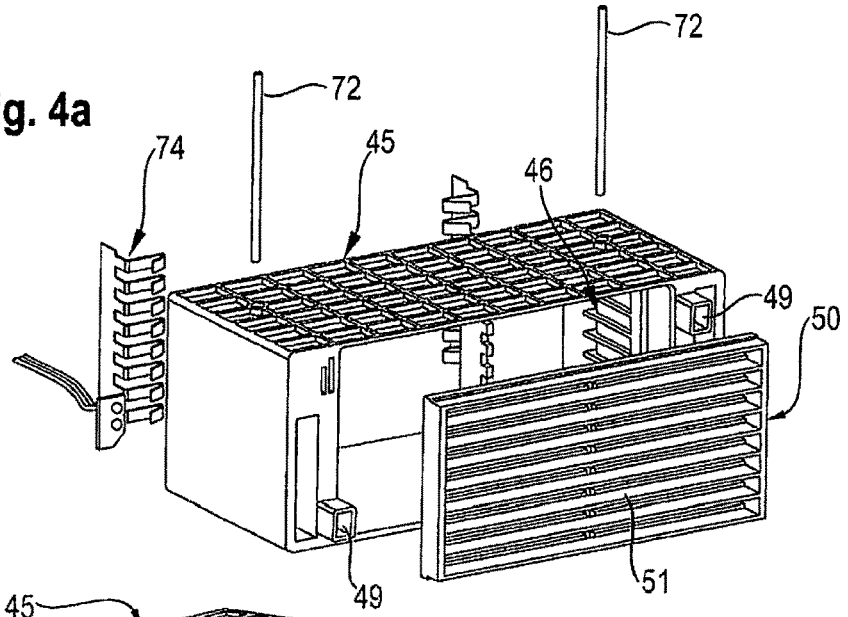
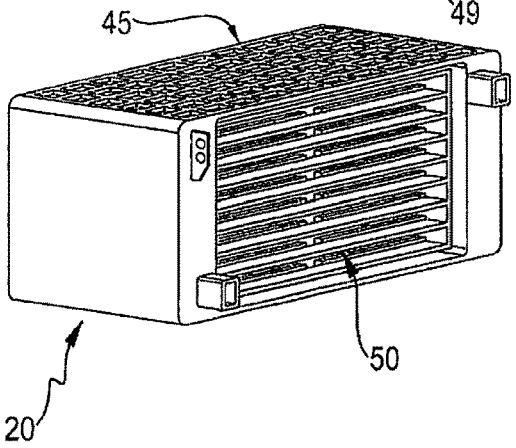
Fig. 4b
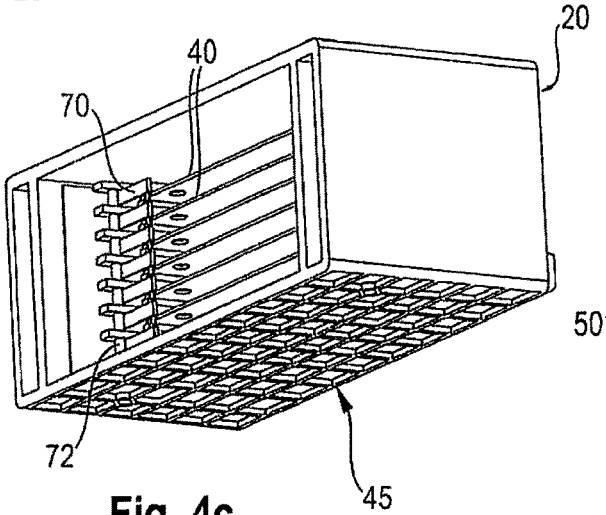
Fig. 4c
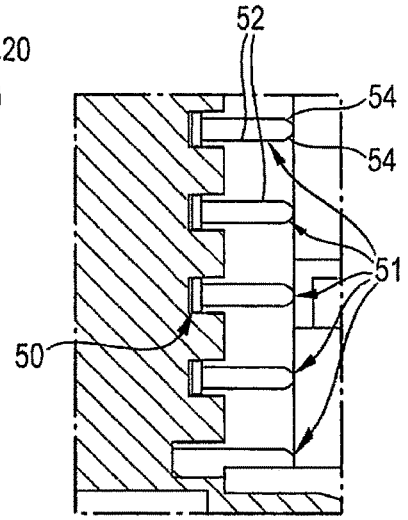
Fig. 4d

PLUG SYSTEM WITH LOW-WEAR CONTACTING

BACKGROUND OF THE INVENTION

1. Field of the Invention

The invention relates to a plug system comprising a plug part with at least one contact element and a mating plug part with at least one contact point on a contact carrier surface running approximately parallel to a plugging direction. The plug part can be plugged into the mating plug part, in the plugging direction, in such a way that the contact element thereby comes into electrical contact with the contact point of the mating plug part.

Such plug systems are in particular suitable for the transmission of numerous signals within a small space; in this case the plug part has a plurality of contact elements and the mating plug part has a plurality of contact points (or contact pads) on the contact carrier surface which are in each case brought into electrical contact with the associated contact element when the plug part and mating plug part are plugged together.

2. Description of Related Art

Conventionally, circuit boards or printed circuit boards (PCBs) are often used for the transmission of numerous signals or current paths within a small space, the surface thereof being, at least in portions, configured as a contact carrier surface which carries the contact points. The contact points can be in the form of exposed, gold-plated contact surfaces or can be formed of copper which is applied to the contact carrier surface, or can be electroplated.

If a signal is to be transmitted from such a printed circuit board to another conductor (cable, plug connector, further printed circuit board), then there are several possible ways of establishing an electrically conductive connection. On the one hand, one can solder the contact partner directly onto the printed circuit board. This is a very reliable method of transmitting signals with as little loss as possible. The big disadvantage of this connection is that is no longer disconnectable. Further disadvantages include longer installation times and thermal stress.

It is also known in the prior art for disconnectable connections to be made between printed circuit boards and other signal conductors. These are in many cases designed such that, during the plugging operation, metallic contact elements of a plug part slide directly along the contact carrier surface of the printed circuit board and are pushed further as far as an end position (completely plugged in). A "plug part" is thereby understood to be any type of plug connector, for example a pluggable printed circuit board, a socket part, a plug part, etc., which is configured to be plugged together or coupled with a "mating plug part" of complementary design, wherein in a coupled end position electrical signals or currents can be transmitted from the contact elements of the plug part to the contact points of the mating plug part. The coupled end position is thereby preferably disconnectable, so that the plug part and the mating plug part can be decoupled from one another again.

A conventional plug system is illustrated by way of example and in simplified form in the FIGS. 6*a* to 6*d*: reference number 10' identifies the plug part carrying several contact elements 30' and reference number 20' identifies the mating plug part, in the form of a printed circuit board, which has on a contact carrier surface several contact points

44' in the form of contact pads. In order to couple said parts, the plug part 10' is moved in a plugging direction S running parallel to the contact carrier surface in the direction of the mating plug part 20' (FIG. 6*a*) until the contact elements 30' in the form of contact springs come to rest against the contact carrier surface (FIG. 6*b*).

During the course of the further plugging movement, the contact elements 30' are compressed by the contact carrier surface and moved so as to scrape along the contact carrier surface (FIG. 6*c*) until the contact elements 30' are finally opposite the contact points 44' and make electrical contact with these (FIG. 6*d*). During the course of the scraping movement from FIG. 6*c* to FIG. 6*d* the contact elements 30' necessarily press continuously with a full contact normal force against the contact carrier surface. This long travel distance subject to friction means a lot of abrasion.

When scraping with a high pressing force over the entire length of the contact carrier surface, the contact elements 30' create undesirable abrasion. With each plugging operation, a certain proportion of the contact coating is thus worn away, as a result of which the contact resistance steadily increases and at the same time soiling in the contact region through conductive chips or similar increases. This can lead to a drastically reduced insulation resistance between the contact points of the printed circuit board, going as far as a short circuit.

A further disadvantage of known plug systems is that, due to the aforementioned contact normal forces, with an increasing number of signals the overall plugging force is also increased, since the contact normal force creates a corresponding frictional force between the contact element and the point on the printed circuit board throughout the entire plugging operation, which increases the plugging force which needs to be applied in the plugging direction.

SUMMARY OF THE INVENTION

In view of the problems described, it was the object of the present invention to develop a plug system which permits a high number of channels within a small space. The wear behavior of the contact partner is thereby to be optimized, and the plugging forces should be as low as possible in order to facilitate the plugging operation. At the same time however, the contact forces should be sufficiently high to guarantee a reliable transmission of both high frequency signals and supply currents.

According to the invention, this problem is solved by means of a plug system according to the independent claims. Advantageous further developments of the invention are described in the dependent claims.

The above and other objects, which will be apparent to those skilled in the art, are achieved in the present invention which is directed to a plug system comprising a plug part with at least one contact element and a mating plug part with at least one contact point on a contact carrier surface running approximately parallel to a plugging direction (S), wherein the plug part can be plugged into the mating plug part in the plugging direction (S) and in an end position (II) the at least one contact element is in electrical contact with the contact point, wherein the mating plug part has a counter-pressure surface arranged, at least in portions, opposite the contact carrier surface in a pressing direction (H) oriented transversely to the plugging direction, wherein the contact carrier surface is held on the mating plug part so as to be moveable in the plugging direction (S) relative to the counter-pressure surface.

When the plug part is plugged in, the contact carrier surface, together with the contact element preferably resting substantially without pressure against, or arranged opposite the contact point, without play, can be displaced in the plugging direction (S) until the contact element is introduced into an intermediate space between the counter-pressure surface and the contact carrier surface and as a result is pressed against the contact point in the end position (II). At least one contact element is flexible.

The dimension of the contact element in the pressing direction (H) is greater, in the relaxed state, than the distance between the contact carrier surface and the counter-pressure surface opposite this, so that the at least one contact element can be clamped therebetween.

The at least one contact element in each case have a self-supporting first leaf spring part projecting in the plugging direction (S) with a first contact region intended to rest against the contact point and a second leaf spring part bent back from a front end of the first leaf spring part with a second contact region intended to rest against the counter-pressure surface in the end position (II).

The plug part has a plurality of contact elements arranged next to one another in a breadthwise direction (B), and/or the mating plug part has a plurality of contact points arranged next to one another in the breadthwise direction (B) on the contact carrier surface which, on plugging-in, in each case come into electrical contact with an associated contact element.

The mating plug part comprises at least one circuit board element, for example a printed circuit board with two opposing contact carrier surfaces, and/or the plug part comprises at least one contact element pair consisting of two contact elements arranged opposite one another in the pressing direction (H), between which the circuit board element can be introduced during the plugging operation.

The mating plug part may comprise two, three or more circuit board elements, in each case extending in the plugging direction (S) with two contact carrier surfaces which can in each case be inserted between contact element pairs until each contact element makes electrical contact with an associated contact point.

A distance (A) between the contact elements of the at least one contact element pair substantially corresponds to the thickness of the circuit board elements.

The at least one circuit board element is arranged displaceably between two counter-pressure surfaces of the mating plug part which are provided in order to press the opposing contact elements of the contact element pairs of the plug part against the contact carrier surfaces of the circuit board element.

The circuit board elements in each case pass through intermediate spaces of a lamellar body containing the counter-pressure surfaces, wherein the lamellae of the lamellar body have ramp surfaces facing the plug part and/or running obliquely to the plugging direction (S).

The plug part may have at least one limit-stop surface against which a front surface of the at least one circuit board element comes to bear during the plugging operation, wherein the circuit board element is pushed in the plugging direction (S) by the limit-stop surface during the plugging operation.

The plug part can be displaced from an intermediate position (I) in which the contact elements are in each case already correctly positioned opposite the associated contact points, but substantially free of contact pressure, into the end position (II) in which the contact elements are in each case clamped between a circuit board element and a counter-pressure surface and as a result are pressed against the associated contact point.

Each contact carrier surface, in particular each circuit board element, may be assigned at least one preloading element, against the preload of which the contact carrier surface can be displaced in the plugging direction (S).

A leaf spring comb may be arranged behind the circuit board elements in the plugging direction and which has a plurality of spring elements.

In a second aspect, the present invention is directed to a plug connector of a plug system, the plug system comprising a plug part with at least one contact element and a mating plug part with at least one contact point on a contact carrier surface running approximately parallel to a plugging direction (S), wherein the plug part can be plugged into the mating plug part in the plugging direction (S) and in an end position (II) the at least one contact element is in electrical contact with the contact point, wherein the mating plug part has a counter-pressure surface arranged, at least in portions, opposite the contact carrier surface in a pressing direction (H) oriented transversely to the plugging direction, wherein the contact carrier surface is held on the mating plug part so as to be moveable in the plugging direction (S) relative to the counter-pressure surface.

In a third aspect, the present invention is directed to a mating plug connector of a plug system, the plug system comprising a plug part with at least one contact element and a mating plug part with at least one contact point on a contact carrier surface running approximately parallel to a plugging direction (S), wherein the plug part can be plugged into the mating plug part in the plugging direction (S) and in an end position (II) the at least one contact element is in electrical contact with the contact point, wherein the mating plug part has a counter-pressure surface arranged, at least in portions, opposite the contact carrier surface in a pressing direction (H) oriented transversely to the plugging direction, wherein the contact carrier surface is held on the mating plug part so as to be moveable in the plugging direction (S) relative to the counter-pressure surface.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIGS. 1*a* to 1*d* show four steps during the course of a plugging operation in which a plug system according to the invention consisting of a plug part and a mating plug part is coupled, in a schematic sectional view;

FIGS. 4*a* to 4*d* show different (partial) views of the mating plug part of the plug system according to the invention;

DESCRIPTION OF PREFERRED EMBODIMENT(S)

Figure 3:
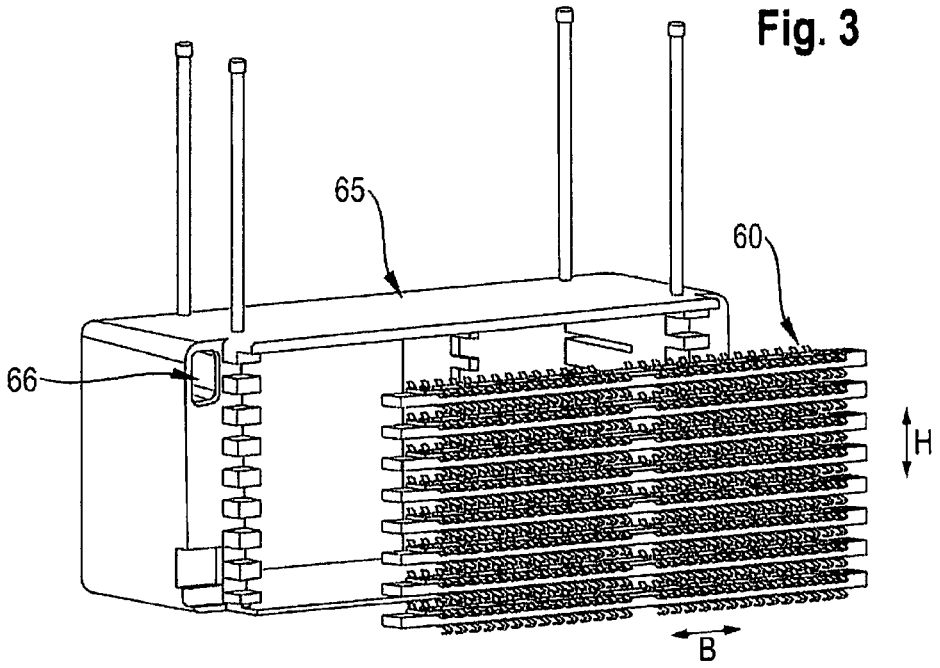
FIG. 3 shows the plug part of the plug system according to the invention in a view serving the purpose of explanation.

In describing the preferred embodiment of the present invention, reference will be made herein to FIGS. 1-6 of the drawings in which like numerals refer to like features of the invention.

In a plug system according to the invention, the mating plug part has a counter-pressure surface arranged opposite the contact carrier surface in a pressing direction oriented transversely, in particular perpendicular, to the plugging direction. The contact carrier surface is held moveably on the mating plug part in such a way that it can be displaced in the plugging direction relative to the counter-pressure surface, which is held immoveably on the mating plug part.

Consequently, an intermediate space is present between the contact carrier surface and the counter-pressure surface into which the contact element of the plug part can be received in an end position. In the end position, the contact element is thus pressed by the counter-pressure surface against the contact point of the contact carrier surface.

In other words, the contact carrier surface is held moveably on the mating plug part in such a way that when the plug part is plugged in, it is, together with the contact element, displaceable in the plugging direction into the end position. Only in the end position is the contact element pressed against the contact point, in the pressing direction oriented transversely to the plugging direction, wherein in the end position the contact element is received in the intermediate space between the counter-pressure surface and the contact carrier surface and as a result is pressed against the contact carrier surface, so that a reliable electrical contact between the contact element and the contact point is established.

According to the invention, the contact carrier surface is held on the mating plug part so as to be displaceable in the plugging direction. This has the advantage that, unlike in conventional plug systems, the contact element is not moved under pressure relative to the contact carrier surface, thereby scraping over the contact carrier surface or over the contact point. Instead, the contact element can first be brought into a position in which it is already correctly positioned opposite the contact point (preferably without touching it), and only then is the contact carrier surface moved, together with the plug part, in the plugging direction, as a result of which the contact element is clamped in the intermediate space between the contact carrier surface and the counter-pressure surface.

The invention is based on the knowledge that in conventional plug systems the abrasive relative movement between the contact partners leads to the problems explained above and should therefore be avoided as far as possible. Therefore, according to the invention the contact element is moved in the plugging direction together with its contact partner—but substantially without compressive force in the normal direction (pressing direction)—as far as its axial end position, and only then is it pressed, in the pressing direction, against the contact point in that it is clamped between the counter-pressure surface and contact carrier surface. An abrasive relative movement thereby only takes place between the counter-pressure surface and the contact element, but not between the contact carrier surface and the contact element.

In order to ensure that a physical contact with the counter-pressure surface only occurs if the contact element is already positioned substantially correctly opposite the contact point, it can be expedient if the contact carrier surface projects further in the direction of the plug part than the counter-pressure surface. In this case, during the course of the plugging operation the contact element is first positioned correctly relative to the contact point, and only on being plugged in further is the contact element brought into contact with the counter-pressure surface which begins behind this in the plugging direction.

Furthermore, according to the invention the contact normal force between contact point and contact element necessary for signal transmission is not generated in that the spring preload of the contact element, which is designed in the form of a contact spring, acts between a contact surface of the plug part and the contact carrier surface of the mating plug part. Instead, according to the present invention the spring preload of the contact element, which is designed in the form of a contact spring, preferably acts between two surfaces of the mating plug part, namely between the counter-pressure surface and the contact carrier surface. This has the advantage that the spring force can be absorbed by a component which does not participate in the electrical contact—namely the counter-pressure surface.

A reliable contact force between the contact element and the contact point can be guaranteed in that the at least one contact element is flexible in design, preferably in the form of an elastic contact spring. A particularly high number of plugging cycles with consistent contact force can be achieved if the contact element is designed in the form of a leaf spring element.

As explained above, in the end position the leaf spring element is received in an intermediate space between the contact carrier surface and the counter-pressure surface and as a result is pressed against the contact point. In order to achieve a good contacting it is thereby expedient if the dimension of the leaf spring element in the pressing direction is greater, in the relaxed state, than the distance between the contact carrier surface and the counter-pressure surface opposite this, preferably more than 1.1 times as great, in particular more than 1.2 times as great or greater. In this way, a good clamping effect is achieved without a disproportionately high plugging force being necessary for the plugging operation.

According to a particularly preferred embodiment of the invention, the leaf spring element has a substantially self-supporting first leaf spring part projecting in the plugging direction with a first contact region intended to rest against the contact point. In addition, the leaf spring element can have a second leaf spring part bent back from a front end of the first leaf spring part with a second contact surface intended to rest against the counter-pressure surface in order to apply pressure on the leaf spring element in the pressing direction. In this case, the dimension of the leaf spring part in the pressing direction is preferably measured between the first and the second contact region. If the leaf spring element is received in the intermediate space between the counter-pressure surface and the contact carrier surface, the second contact region is pressed by the counter-pressure surface against the first contact region and as a result the leaf spring element as a whole is compressed elastically in the pressing direction. Alternatively or additionally, it can be expedient if the second leaf spring part has a front surface running, at least in portions, obliquely in relation to the plugging direction, so that during plugging-in the leaf spring part is gradually compressed through pressure contact with the counter-pressure surface and the contact force can be built up gradually. Such a design of the contact element makes possible a well-measured and reliably acting contact force in the end position.

In the case of a plurality of contact elements, all the contact elements can be of similar or substantially identical design, whereby the plugging force necessary for coupling can be influenced through the choice of material thickness, the dimension in the pressing direction and the shape of the leaf spring elements.

The plug system according to the invention is preferably configured for the transmission of a plurality of signals, wherein in this case the plug part can have a plurality (for example 5, 10, 30 or more) of contact elements arranged next to one another in a breadthwise direction (B) and the mating plug part can have a plurality of contact points arranged next to one another in the breadthwise direction (B) on the contact carrier surface which, on plugging-in, in each case come into in electrical contact with an associated contact element. The breadthwise direction is thereby oriented transversely, in particular perpendicular, to the plugging direction and the pressing direction. Preferably, starting out from a spring carrier of the plug part, the contact elements, designed as contact springs, project next to one another in the direction of the mating plug part, wherein the contact points are formed, as contact pads, next to one another at corresponding intervals in the contact carrier surface.

A particularly compact design of the plug system is possible in that the mating plug part comprises a circuit board element, for example a printed circuit board (PCB) with two opposing contact carrier surfaces and/or in that the plug part comprises at least one contact element pair consisting of two contact elements arranged opposite one another in the pressing direction (H), between which the circuit board element can be introduced. In other words, both the upper and also the lower boundary surface of the printed circuit board are, at least in portions, configured as a contact carrier surface with contact points for contacting contact elements, wherein both the upper and also the lower boundary surface of the printed circuit board can carry numerous contact points arranged next to one another in the breadthwise direction (B). The contact elements of the contact element pairs arranged opposite one another can be arranged substantially symmetrically in relation to the plane of the printed circuit board, which simplifies the structure and the contacting.

In order to achieve a low-wear contacting it has proved expedient if a distance (A) between the contact elements of the contact element pairs substantially corresponds to the thickness of the circuit board elements. In this case, during the course of the plugging operation, the circuit board element is first introduced, initially without contact pressure but substantially free of play in the pressing direction, into the intermediate space between the contact elements of the contact element pairs, until the contact elements of the associated contact points are in each case opposite the two sides of the printed circuit board. Only then is pressure applied to the contact points in the pressing direction in that the circuit board element, together with the contact elements of the contact element pairs, is displaced relative to two counter-pressure surfaces until the contact elements are pressed by the counter-pressure surfaces in the pressing direction, on both sides, in the direction of the circuit board element. This symmetrical structure leads to a symmetrical contact pressure on the two opposing contact carrier surfaces of the circuit board elements and thus to a particularly even and stable contacting.

In order to achieve an even higher contact density of the plug system it is advantageous if the mating plug part comprises two, three or more, in particular eight circuit board elements, for example printed circuit boards, in each case extending in the plugging direction (S), wherein, preferably, in each case both main circuit board surfaces are designed, at least in portions, in the form of contact carrier surfaces. The individual circuit board elements are thereby preferably arranged on top of one another in the pressing direction. The circuit board elements can then in each case be introduced substantially without contact pressure between rows of contact element pairs, and the contact elements can then in each case be pressed against the associated contact points by means of pairs of counter-pressure surfaces arranged opposite one another.

In the case of a plurality of circuit board elements, it is advantageous if at least two circuit board elements and/or counter-pressure surfaces are displaced relative to one another in the plugging direction, so that during the course of the plugging operation not all contact elements come into contact with a counter-pressure surface, and are as a result pressed together, simultaneously. Otherwise, a particularly high plugging force would be necessary at a particular point during the plugging operation. In contrast, if for example the counter-pressure surfaces begin at different positions in an alternating manner, the forces necessary in order to press together the contact elements are applied at two (or more) points in the plugging direction, so that the necessary maximum force is reduced.

The first force peak can be higher than the following force peaks, with plugging being continued up to the end. This ensures that all the contacts are plugged together.

A particularly good and stably-guided plugging operation is possible if the circuit board elements are in each case arranged, displaceably and preferably substantially centrally in the pressing direction, between two counter-pressure surfaces of the mating plug part. The first counter-pressure surface is provided in order to press contact elements on the first contact carrier surface of the circuit board element, and the second counter-pressure surface is provided in order to press the contact elements which are in each case arranged opposite against the opposing contact carrier surface of the circuit board element.

The manufacture of a plug system according to the invention can be simplified in that the circuit board elements in each case pass through intermediate spaces of a lamellar body carrying the counter-pressure surfaces, wherein preferably the lamellae of the lamellar body can have ramp surfaces facing the plug part and/or running obliquely to the plugging direction. The ramp surfaces can gradually transition into the counter-pressure surfaces running parallel to the plugging direction. The lamellar body can be formed as a single part and can carry a plurality of lamellae, each with two counter-pressure surfaces. Alternatively, the lamellae of the lamellar body can in each case be attached separately to a housing of the mating plug part. The important thing is that the individual printed circuit boards project through the intermediate spaces between the lamellae, so that the contact elements and the printed circuit boards are already positioned correctly relative to one another when the contact elements pass into the intermediate spaces between the lamellae.

Preferably, the plug part has at least one limit-stop surface against which a front surface of the at least one circuit board element comes to bear during the plugging operation and by which the circuit board element is pushed in the plugging direction.

A low-wear contacting operation enabling a good contact can be achieved in that the plug part can be displaced from an intermediate position in which the contact elements are in each case already correctly positioned opposite the associated contact points, but substantially free of contact pressure, into the end position in which the contact elements are in each case clamped between a circuit board element and a counter-pressure surface and as a result are pressed against the associated contact point.

The limit-stop surface of the plug part is preferably arranged such that the front surface of the circuit board elements comes to bear against it if the contact elements of the contact points are correctly positioned opposite. From this point, the circuit board element is pushed forwards in the plugging direction relative to the counter-pressure surfaces.

In order to enable the contact carrier surfaces or the circuit board elements to move in the plugging direction, the circuit board elements are preferably guided displaceably in guide slots running in the plugging direction.

Preferably, each contact carrier surface or each circuit board element is assigned at least one preloading element, for example a spring element, against the preload of which the circuit board element can be displaced in the plugging direction. Before the plug part is plugged in, the circuit board elements are biased by the preloading elements in the direction of the plug part in order to ensure that circuit board elements are located in an interface-side position during the plugging operation. The necessary plugging force can be adjusted by means of the spring force of the preloading elements. A limit stop (for example a shoulder of the lamellar body) can be provided on the mating plug part, against which the plug part comes to bear on reaching the end position. The spring elements can in each case be provided as leaf springs behind the circuit board elements which are guided within guides.

In order to achieve a structurally and constructively simple structure of the mating plug part it has proved expedient to provide a leaf spring comb which is arranged behind the circuit board elements in the plugging direction and which comprises a plurality of spring elements, wherein each circuit board element is associated with at least one leaf spring of the leaf spring comb which forces the respective circuit board element in the direction of the plug part. Preferably, two leaf spring combs with in each case one leaf spring per circuit board element are provided.

The preloading elements, the circuit board elements with the contact carrier surfaces and/or the counter-pressure surfaces, preferably designed in the form of lamellae, can be accommodated in a common housing of the mating plug part in which the circuit board elements are arranged in layers on top of one another in the pressing direction.

Alternatively or additionally, a number of contact element carriers corresponding to the circuit board elements can be accommodated in a common housing of the plug part in which the contact element carriers are arranged in layers on top of one another in the pressing direction. The contact elements, designed in the form of contact springs, preferably project next to one another from a front side of each contact element carrier. Two opposing rows of contact elements arranged opposite one another in the pressing direction are thereby preferably provided, wherein a circuit board element can in each case be inserted between the individual contact element pairs of these two rows.

The invention also relates to a plug part of a plug system according to the invention as well as a mating plug part of a plug system according to the invention.

In the following description, the invention is described with reference to the enclosed drawings, in which a particularly preferred exemplary embodiment of the invention is illustrated.

In the following, the present invention is described with reference to a particularly advantageously designed plug system:

In principle, the plug system 100 represented in FIG. 1 consists of a plug part 10 and a mating plug part 20. The plug part is illustrated in detail in FIGS. 2 and 3 and the mating plug part is illustrated in detail in FIGS. 4*a* to 4*d*.

Figure 2:
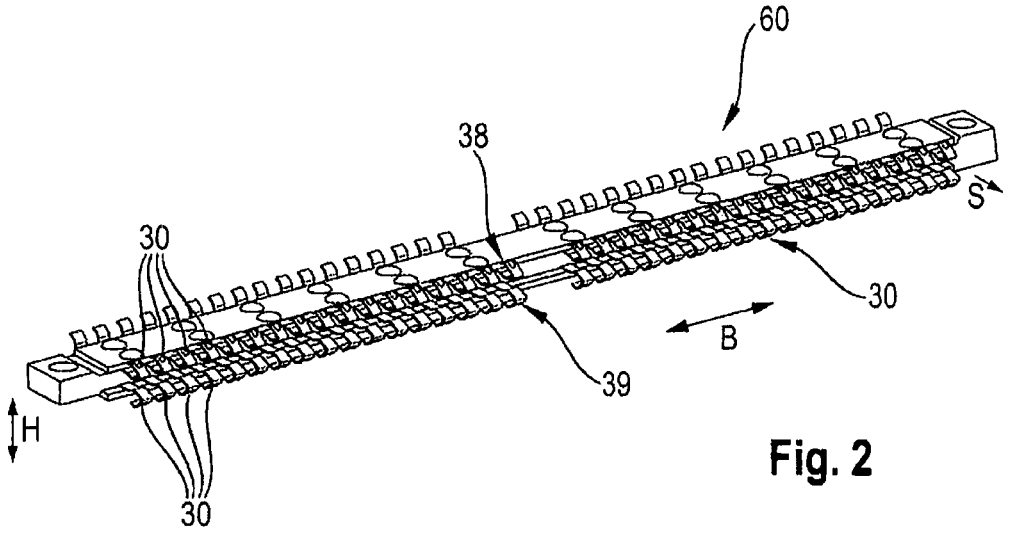
FIG. 2 shows a contact element carrier of the plug part of the plug system according to the invention in a perspective view.
Figure 5:
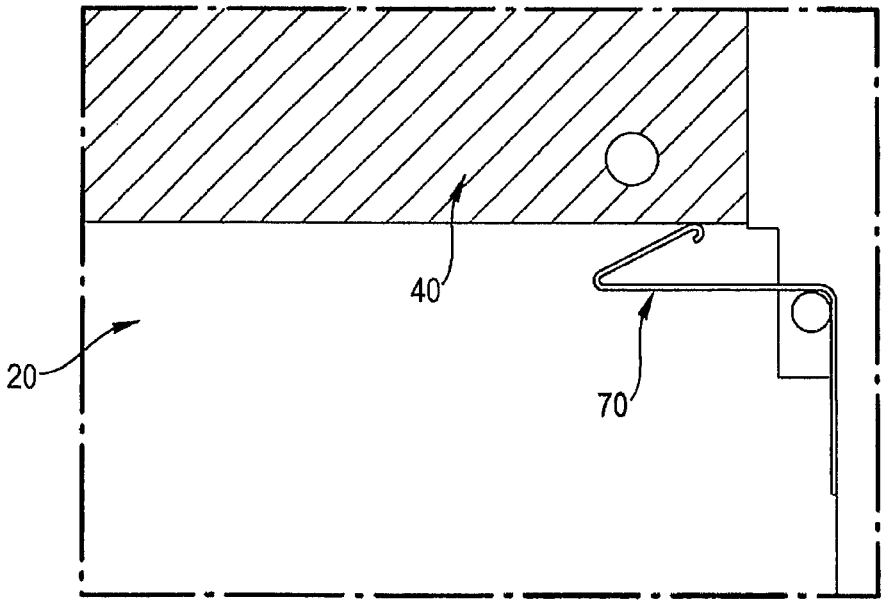
FIG. 5 shows the rear end of a circuit board element of the mating plug part in a top view.
Figure 6A:
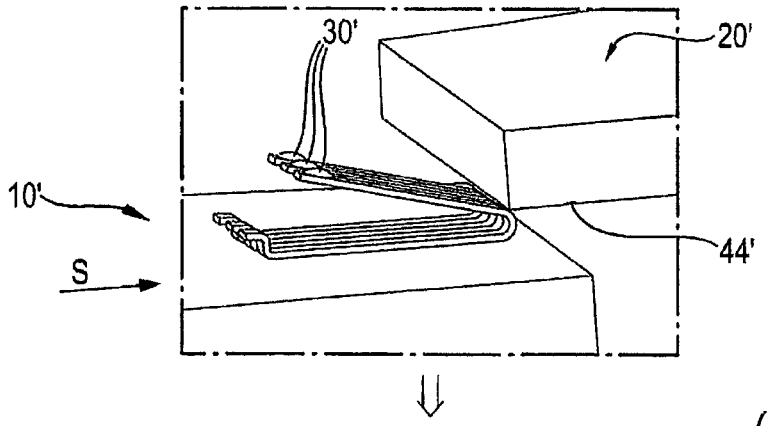
Fig. 6a (PRIOR ART)
FIGS. 6*a* to 6*d* show four steps during the course of a plugging operation in which a conventional plug system consisting of a plug part and a mating plug part is coupled.
Figure 6B:
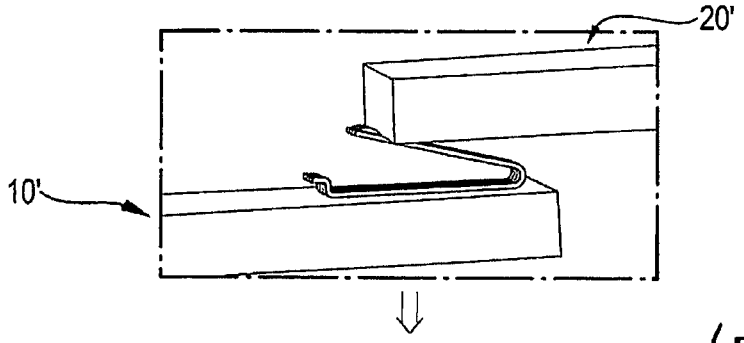
Fig. 6b (PRIOR ART)
Figure 6C:
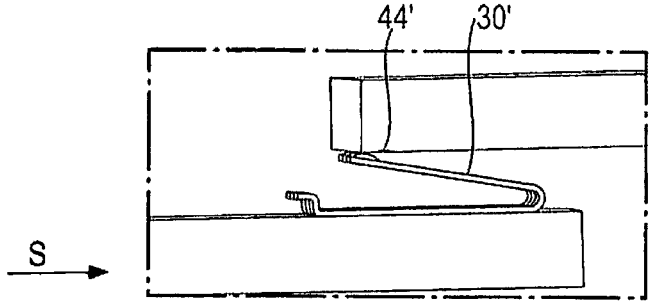
Fig. 6c (PRIOR ART)
Figure 6D:
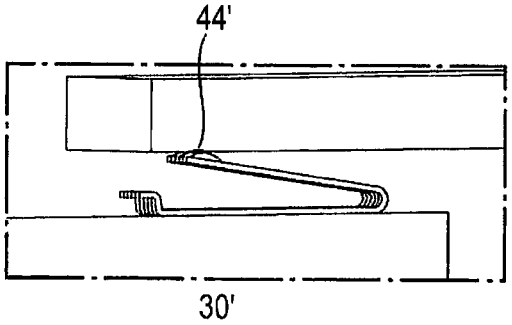
Fig. 6d (PRIOR ART)

Several contact element carriers 60 are held in fixed position in a housing 65 of the plug part 10, which is open on two sides (see FIGS. 2 and 3). On one side of the contact element carrier 60 cables are soldered to the conductor tracks of a circuit board, emerging from the housing 65 on the so-called "cable side". They serve to transmit signals further to other components.

On the second open side of the housing 65, the so-called "interface side", which during the plugging operation leads in the plugging direction S or faces the mating plug part, contact elements 30 in the form of contact springs are attached to the contact element carrier 60, both on the upper side and on the underside, which project from the contact element carrier 60 in the plugging direction S. Two contact elements 38, 39 arranged opposite one another are referred to in the following as a contact element pair. These are ideally soldered directly onto the conductor tracks of the contact element carrier 60. An empty space is formed between the upper and the lower contact elements 38, 39 of the contact element pairs with an distance A which is at least so large that the thickest printed circuit board 40 intended for insertion of the mating plug part 20 can be inserted as contact partner between these contact elements 38, 39 in a substantially frictionless manner.

The contact elements 38, 39 of the contact element pairs are, at least partially, arranged opposite one another in a pressing direction H which runs perpendicular to the plugging direction S. On the interface side of the contact element carrier 60, numerous contact element pairs (in this case, by way of example, 34) are arranged next to one another in a breadthwise direction B, which runs perpendicular to the plugging direction S and the pressing direction H. A contact element carrier is thus configured for the transmission of 68 signals, wherein eight contact element carriers 60 are accommodated in the housing 65 on top of one another in the pressing direction H. Depending on the required number of signal paths, more or fewer contact elements per contact element carrier 60 or more or fewer than eight contact element carriers 60 can be provided in the housing 65.

It can be seen particularly clearly in FIGS. 1*a* to 1*d* that the contact elements 30 in each case have a first leaf spring part 32, fixed to the contact element carrier 60 and substantially projecting from the contact element carrier in the plugging direction S, with a first contact region for making electrical contact with a contact point 44 of the mating plug part 20. The contact element 30 is bent back and has a second leaf spring part 34 substantially running back contrary to the plugging direction S from the front end of the first leaf spring part 32, with a second contact region designed to bear against a counter-pressure surface 52 of the mating plug part 20 in the end position II. The contact elements 30 are thus configured to be elastically compressible in the pressing direction H. If they are received into the intermediate space between the counter-pressure surfaces 52 and the printed circuit board 40, which is somewhat narrower than the dimension of the contact element 30 in the pressing direction (measured between the two contact regions), they are elastically compressed, so that in each case a compressive force acts between the first contact surface of the contact element 30 and the associated contact point 44 of the printed circuit board 40.

On a front side of the housing 65 (interface side) one can see two diagonally-arranged recesses 66. At the beginning of the plugging operation, these receive matching counterparts (pins 49) of the mating plug part 20 in order to guarantee an adequate pre-centering of all components participating in the plugging operation.

The mating plug part 20 illustrated in FIGS. 4*a* to 4*d* is explained as follows. FIG. 4*a* shows different components of the mating plug part 20 in an exploded view, FIG. 4*b* shows the fully assembled mating plug part 20 in a perspective view, FIG. 4*c* shows the mating plug part 20 viewed diagonally from behind and FIG. 4*d* shows a partial view of the mating plug part 20 in a sectional view.

Guide slots 46 arranged laterally opposite one another can be found in a housing 45, which is also open on two sides. The number and precise form of the guide slots 46 are immaterial for the purpose of further considerations. Circuit board elements in the form of printed circuit boards 40 are pushed into these guide slots 46, the upper and lower main surfaces of which are designed, on the interface side (the side intended for coupling with the plug part 10 and which faces the plug part 10 during the plugging operation) in the form of opposing contact carrier surfaces 42, 43. The contact carrier surfaces 42, 43 in each case have a plurality of contact points 44 arranged next to one another in the breadthwise direction which are intended to make electrical contact with the contact elements 30.

As already described for the housing 65 of the plug part 10, on the cable-side of the housing 45 facing away from the plug part 10, cables are soldered to the conductor tracks of the printed circuit boards 40 which emerge from the cable-side of the housing 45. A limit stop in the guide slots 46 prevents the printed circuit boards 40 from projecting too far out of the housing 45 on the interface side or from falling out. The printed circuit boards 40 are pressed against this limit stop by means of spring elements 70 which are arranged on the cable-side end behind the printed circuit boards 40 and are accommodated in the guide slots 46 so as to be displaceable in the cable-side direction against the preload of the spring elements 70. This is relevant to the further function. In the embodiment illustrated here, the spring elements 70 are stamped sheet metal springs, which on the one hand press, with individual resilient fingers, against the printed circuit boards 40, and are supported against the side wall of the housing 45 with the fixed, non-resilient part. A pin 72 secures each spring element 70 against falling out and at the same time makes it possible for the spring forces to be deflected against the wall of the housing 45. Spring elements 70 for the individual printed circuit boards 40, arranged on top of one another in the pressing direction H, in each case form a leaf spring comb 74, which is illustrated particularly clearly in FIG. 4*a*. A cable-side end of a printed circuit board 40 with the spring element 70 pre-loading the printed circuit board in the direction of the plug part 10 is illustrated in enlarged form in FIG. 5.

The design of the spring elements 70 shown here is exemplary. Any other form which presses the printed circuit boards 40 against the limit stop in the guide slots 46 is conceivable. The printed circuit boards 40 are thus mounted so as to be moveable in the plugging direction S, whereby in the unplugged state they are in an interface-side end position in which they project in the direction of the plug part 10 which is to be plugged in.

A further important component now comes into play, namely a lamellar body 50. This is designed such that it comprises a plurality of parallel lamellae 51. These lamellae 51 are substantially rectangular in cross section (see FIG. 4*d*), whereby each lamella has on the interface side a small chamber at the top and bottom, the so-called ramp surface 54. The ramp surfaces 54 in each case transition into the counter-pressure surfaces 52 of the lamellae 51 by means of which the contact elements 30 are pressed against the contact points 44. The lamellar body 51 is installed in a fixed position in the housing 45 in an appropriate manner (e.g. pressed, glued or created directly during injection-molding), so that the ramp surfaces 54 point in the direction of the interface. In order to distribute the plugging forces better over the entire plugging operation it can be particularly expedient to offset the ramp surfaces 54 relative to one another in the plugging direction S (not shown here).

The printed circuit boards 40 are accommodated in the housing 45 in such a way that on the interface side they project through the intermediate spaces between the lamellae 51 substantially centrally.

The housing 45 also has elements serving the purpose of pre-centering, in the form of two pins 49.

The plugging operation, in which the plug part 10 is plugged into the mating plug part 20 in the plugging direction S, is described in the following with reference to FIGS. 1*a* to 1*d*. In the first step, the pre-centering elements (pins 49 and recesses 66) are brought into engagement with one another. This causes the housings 45, 65 of plug part and mating plug part as well as the components installed therein to be oriented in the correct position relative to one another. This prevents possible damage to the sensitive components (contact elements, contact points etc.) during the plugging operation. On further pressing-together of the plug part 10 and mating plug part 20, on the interface side geometry elements of the housings slide into one another in such a way that a further peripheral centering of the two plugging partners relative to one another takes place.

The printed circuit boards 40 are thereby inserted into the intermediate spaces between the contact elements 38, 39 of the contact element pairs which project from the contact element carriers 60 of the plug part, but without thereby touching these and without scraping along these (see FIG. 1*a*).

If the plug part 10 and the mating plug part are pushed further into one another, then the printed circuit boards 40 come to rest against limit-stop surfaces 62 of the contact element carrier 60, so that from this time no further relative movement of contact elements 30 and printed circuit boards 40 in the plugging direction S can take place. The plug system is arranged in the intermediate position shown in FIG. 1*b*.

At this time, the contact elements 30 and the contact points 44 (landing pads) on the contact carrier surfaces 42, 43 of the printed circuit boards 40 are aligned optimally with one another, but are still not yet in contact. At this point it should be remembered that the printed circuit boards 40 are spring-mounted and displaceable in the cable-side direction. This now becomes important, since the plug part 10 and the mating plug part 20 are pushed even further into one another; however, the printed circuit boards 40 are already pressed against the limit-stop surfaces 62.

With advancing plugging travel, the lamellar body 50 now comes into play (see FIG. 1*c*). The counter-pressure surfaces 52 formed by the lamellae 51 run with their ramp surfaces 54 onto the contact elements 30, so that these are introduced into the intermediate space between the printed circuit boards 30 and lamellae 51 and are thereby pressed against the already positioned contact points 44 of the printed circuit boards 40. The contact carrier surfaces 42, 43 are thus thereby moved together with the correctly positioned contact elements 30 relative to the counter-pressure surfaces 52 held in a fixed position on the housing 45. The electrical contact is finally established (see FIG. 1*d*).

As already mentioned, the ramp surfaces 54 can be offset relative to one another in the plugging direction in order to the reduce the value of the maximum plugging force. However, this is not shown here since it is unnecessary in this variant.

The further the plug part 10 and the mating plug part 20 are pushed into one another, the greater the contact force between the contact springs 30 and the printed circuit boards 40 in the pressing direction H running perpendicular to the plugging direction S. The maximum contact force is reached at the end of the ramp surfaces 54, which then transition into the straight counter-pressure surfaces 52 which are oriented substantially parallel to the plugging direction S, as a result of which the contact force remains constant at the desired value. The plug part 10 and the mating plug part 20 are pushed further into one another (the relative position of the contact elements 30 and the contact points 44 on the contact carrier surfaces 42, 43 thereby remains unchanged) until the housing 65 comes to rest against the lamellar body 50. The plugging operation is completed.

When disconnecting the plugged connection, the procedure described above takes place in the reverse order.

The plug system according to the invention offers the following advantages in particular in comparison with conventional plug systems:

a) Optimized wear behavior, since the contact elements do not slide over the contact pads over the entire plugging distance, but only come into contact under pressure when no further relative movement takes place between contact element and contact point. Therefore less abrasion, simpler plugging (no frictional force acting from the contact elements on the contact pads contrary to the plugging direction), better pre-centering before the contact is established;

b) Due to the optimized wear behavior, layer thicknesses (e.g. gold plating) on the contact elements and on the contact points can be reduced, which leads to an advantage in terms of costs;

c) Since the contact force does not need to be applied by the contact elements themselves, but is generated through the support in the housing against the counter-pressure surfaces, the contact springs can be made more simply, cheaply and reliably. The packing density (number of contacts per unit area) can also be increased, since the contact elements can be made smaller;

d) The thickness tolerances of the printed circuit boards can be better equalized, since the spring force of the contact elements is generated "externally". This reduces the likelihood of the springs being damaged in the event of an unfavorable tolerance position, or of their making poor contact or no contact at all;

e) The reliability of the contacts is increased, since the contact elements are actively pressed against the contact points. This is in particular advantageous if the plug system is subjected to mechanical loads, for example vibrations; and f) Due to the advantages described, the plug system is scalable and can be adapted optimally to the application in question.

The plug system according to the invention is not limited to the embodiment illustrated in the Figures. In particular, the plug system does not necessarily have a plurality of contact elements and contact points, but can also provide only a single contact path. However, the contact elements opposing one another in the form of contact element pairs, loading the printed circuit boards symmetrically, which make contact with both main surfaces of the printed circuit board offer particular advantages in terms of stability and compactness. However, due to the exactly definable plugging forces without a risk of wear, the plug system according to the invention is particularly well adapted for the transmission of a plurality of signals and therefore preferably has more than 50, in particular more than 100 contact elements and associated contact points.

In an alternative embodiment, after the plug part and mating plug part are plugged together in the plugging direction S, the contact elements do not rest under pressure against the contact points, but are only brought into the end position in which they rest under pressure against the contact points through a further action (for example application of pressure on the contact element carrier, adjustment of the lamellar body, operation of an additional part, etc.).

Alternatively, prior to the plugging operation the contact elements are pre-loaded apart from one another and are only relaxed following plugging by means of various parts and then make contact with the printed circuit board under pressure. Double circuit boards are also conceivable which are clamped together after being plugged.

Alternatively or additionally, the contact elements or the contact element carrier carrying the contact elements can be moveably mounted (for example mounted in a floating manner).

A contact element carrier is not necessarily provided. The contact elements can for example (analogously to the contact points) also be attached directly to circuit board elements, for example printed circuit boards, for example through soldering. The printed circuit boards of the plug part can also be held on the plug part so as to be moveable in the plugging direction.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug system comprising a plug part with at least one contact element and a mating plug part comprising a contact carrier having a contact carrier surface with at least one contact point on the contact carrier surface running approximately parallel to a plugging direction (S), wherein the plug part can be plugged into the mating plug part in the plugging direction (S) and in an end position (II) the at least one contact element is in electrical contact with the contact point, wherein the mating plug part has a counter-pressure surface arranged, at least in portions, opposite the contact carrier surface in a pressing direction (H) oriented transversely to the plugging direction, wherein the contact carrier is held on the mating plug part so as to be moveable in the plugging direction (S) relative to the counter-pressure surface, thereby optimizing the wear behavior of contact partners contact element and at least one contact point on the contact carrier surface, wherein the plug part has at least one limit-stop surface against which a front surface of the contact carrier comes to bear during the plugging operation, wherein the contact carrier is pushed in the plugging direction (S) by the limit-stop surface during the plugging operation.

2. The plug system of claim 1, wherein, when the plug part is plugged in, the contact carrier surface, together with the contact element resting substantially without pressure against, or arranged opposite the contact point, without play, can be displaced in the plugging direction (S) until the contact element is introduced into an intermediate space between the counter-pressure surface and the contact carrier surface and as a result is pressed against the contact point in the end position (II).

3. The plug system of claim 1, wherein the at least one contact element is flexible.

4. The plug system of claim 3, wherein the dimension of the contact element in the pressing direction (H) is greater, in the relaxed state, than the distance between the contact carrier surface and the counter-pressure surface opposite this, so that the at least one contact element can be clamped therebetween.

5. The plug system of claim 4, wherein the at least one contact element in each case have a self-supporting first leaf spring part projecting in the plugging direction (S) with a first contact region intended to rest against the contact point and a second leaf spring part bent back from a front end of the first leaf spring part with a second contact region intended to rest against the counter-pressure surface in the end position (II).

6. The plug system of claim 3, wherein the at least one contact element in each case have a self-supporting first leaf spring part projecting in the plugging direction (S) with a first contact region intended to rest against the contact point and a second leaf spring part bent back from a front end of the first leaf spring part with a second contact region intended to rest against the counter-pressure surface in the end position (II).

7. The plug system of claim 3, wherein the at least one contact element is in the form of an elastically compressible leaf spring element.

8. The plug system of claim 1, wherein the plug part has a plurality of contact elements arranged next to one another in a breadthwise direction (B), and/or the mating plug part has a plurality of contact points arranged next to one another in the breadthwise direction (B) on the contact carrier surface which, on plugging-in, in each case come into electrical contact with an associated contact element.

9. The plug system of claim 8, wherein the plug part has five, ten, thirty, or more of contact elements arranged next to one another in a breadthwise direction (B), and/or the mating plug part has a plurality of contact points arranged next to one another in the breadthwise direction (B) on the contact carrier surface which, on plugging-in, in each case come into electrical contact with an associated contact element.

10. The plug system of claim 1, wherein the mating plug part comprises at least one circuit board element, and/or the plug part comprises at least one contact element pair consisting of two contact elements arranged opposite one another in the pressing direction (H), between which the circuit board element can be introduced during the plugging operation.

11. The plug system of claim 10, wherein a distance (A) between the contact elements of the at least one contact element pair substantially corresponds to the thickness of the circuit board elements.

12. The plug system of claim 11, wherein the at least one circuit board element is arranged displaceably between two counter-pressure surfaces of the mating plug part which are provided in order to press the opposing contact elements of the contact element pairs of the plug part against the contact carrier surfaces of the circuit board element.

13. The plug system of claim 12, wherein the circuit board elements in each case pass through intermediate spaces of a lamellar body containing the counter-pressure surfaces, wherein the lamellae of the lamellar body have ramp surfaces facing the plug part and/or running obliquely to the plugging direction (S).

14. The plug system of claim 13, wherein the plug part has at least one limit-stop surface against which a front surface of the at least one circuit board element comes to bear during the plugging operation, wherein the circuit board element is pushed in the plugging direction (S) by the limit-stop surface during the plugging operation.

15. The plug system of claim 10, wherein the mating plug part comprises two, three or more circuit board elements, in each case extending in the plugging direction (S) with two contact carrier surfaces which can in each case be inserted between contact element pairs until each contact element makes electrical contact with an associated contact point.

16. The plug system of claim 10, wherein the at least one circuit board element is arranged displaceably between two counter-pressure surfaces of the mating plug part which are provided in order to press the opposing contact elements of the contact element pairs of the plug part against the contact carrier surfaces of the circuit board element.

17. The plug system of claim 16, wherein the circuit board elements in each case pass through intermediate spaces of a lamellar body containing the counter-pressure surfaces, wherein the lamellae of the lamellar body have ramp surfaces facing the plug part and/or running obliquely to the plugging direction (S).

18. The plug system of claim 10, wherein the plug part can be displaced from an intermediate position (I) in which the contact elements are in each case already correctly positioned opposite the associated contact points, but substantially free of contact pressure, into the end position (II) in which the contact elements are in each case clamped between a circuit board element and a counter-pressure surface and as a result are pressed against the associated contact point.

19. The plug system of claim 10, wherein each contact carrier surface, in particular each circuit board element, is assigned at least one preloading element, against the preload of which the contact carrier surface can be displaced in the plugging direction (S).

20. The plug system of claim 19, wherein a leaf spring comb is arranged behind the circuit board elements in the plugging direction and which has a plurality of spring elements (70).

21. The plug system of claim 19, wherein said at least one preloading element is a spring element.

22. The plug system of claim 10, wherein the at least one circuit board element includes a printed circuit board with two opposing contact carrier surfaces.

23. The plug system of claim 10, wherein the at least one circuit board element is a printed circuit board with two opposing contact surfaces.

24. A plug connector of a plug system, the plug system comprising a plug part with at least one contact element and a mating plug part comprising a contact carrier having a contact carrier surface with at least one contact point on the contact carrier surface running approximately parallel to a plugging direction (S), wherein the plug part can be plugged into the mating plug part in the plugging direction (S) and in an end position (II) the at least one contact element is in electrical contact with the contact point, wherein the mating plug part has a counter-pressure surface arranged, at least in portions, opposite the contact carrier surface in a pressing direction (H) oriented transversely to the plugging direction, wherein the contact carrier is held on the mating plug part so as to be moveable in the plugging direction (S) relative to the counterpressure surface, thereby optimizing the wear behavior of contact partners contact element and at least one contact point on the contact carrier surface, wherein the plug part has at least one limit-stop surface against which a front surface of the contact carrier comes to bear during the plugging operation, wherein the contact carrier is pushed in the plugging direction (S) by the limit-stop surface during the plugging operation.

25. A mating plug connector of a plug system, the plug system comprising a plug part with at least one contact element and a mating plug part comprising a contact carrier having a contact carrier surface with at least one contact point on the contact carrier surface running approximately parallel to a plugging direction (S), wherein the plug part can be plugged into the mating plug part in the plugging direction (S) and in an end position (II) the at least one contact element is in electrical contact with the contact point, wherein the mating plug part has a counter-pressure surface arranged, at least in portions, opposite the contact carrier surface in a pressing direction (H) oriented transversely to the plugging direction, wherein the contact carrier is held on the mating plug part so as to be moveable in the plugging direction (S) relative to the counterpressure surface, thereby optimizing the wear behavior of contact partners contact element and at least one contact point on the contact carrier surface, wherein the plug part has at least one limit-stop surface against which a front surface of the contact carrier comes to bear during the plugging operation, wherein the contact carrier is pushed in the plugging direction (S) by the limit-stop surface during the plugging operation.

* * * * *